US006761205B1

(12) United States Patent
Atherton

(10) Patent No.: US 6,761,205 B1
(45) Date of Patent: Jul. 13, 2004

(54) BARRIER

(76) Inventor: Eric John Atherton, 83 Wroslyn Road, Freeland, Witney, Oxon (GB), 0X8 8HL ( * ) Notice: Subject to any disclaimer, the term of this patent is extended or adjusted under 35 U.S.C. 154(b) by 0 days.

(21) Appl. No.: 10/049,789

(22) PCT Filed: Aug. 17, 2000

(86) PCT No.: PCT/GB00/03168

§ 371 (c)(1),
(2), (4) Date: Feb. 15, 2002

(87) PCT Pub. No.: WO01/12943

PCT Pub. Date: Aug. 17, 2000

(30) Foreign Application Priority Data

Aug. 17, 1999 (GB) ..... 99193773

(51) Int. Cl.[7] ..... E05F 15/00

(52) U.S. Cl. ..... 160/188; 160/196.1; 160/330; 160/352

(58) Field of Search ..... 160/332, 184, 160/330, 331, 352, 341, 85, 348, 130, 181, 188, 218, 340, 196.1

(56) References Cited

U.S. PATENT DOCUMENTS 4,558,991 A 12/1985 Barr ..... 417/199 R
6,092,583 A * 7/2000 Furusawa ..... 160/330

FOREIGN PATENT DOCUMENTS

| | | | | |
|---|---|---|---|---|
| EP | 98/59142 | | 12/1998 | ..... E06B/5/00 |
| EP | 0921262 | A | * 6/1999 | |
| FR | 2252793 | A | * 6/1975 | |
| FR | 2762591 | A | * 10/1998 | |
| GB | 751591 | A | * 6/1956 | |
| JP | 06135883 | A | * 5/1994 | |

* cited by examiner

*Primary Examiner*—Blair M. Johnson
(74) *Attorney, Agent, or Firm*—Davis & Bujold, P.L.L.C.

(57) ABSTRACT

A flow device for location within an aperture (A) to regulate flow through the aperture on a path from a first location (5) on one side of the aperture to a second location (6) on the other side of the aperture wherein there is provided a barrier (1) defined by a sequence of vertical elements; device for driving the sequence of elements, so that the barrier serves to generate a predetermined wave form along the path such that the barrier serves to create in sequence: an entry region for occupation by at least one individual which entry region is initially open toward the one side of the aperture but isolated from the other side of the aperture; a traversing region (R) on the path generated from the entry region by progressive movement of the barrier, and an exit region open towards the other side of the aperture but isolated form the one side.

12 Claims, 7 Drawing Sheets

BARRIER

FIELD OF THE INVENTION

This invention relates to a barrier providing a method of, and apparatus for, regulating flow from a first location through an aperture to a second location.

BACKGROUND OF THE INVENTION

For sites involving the passage of large number of people (such as an airport, supermarket or sports arena) there frequently occurs a need to cause a flow of people to pass in an orderly manner in a particular direction from a first to a second location There may also arise a need for a flow occurring in one direction for a given period to be reversed in direction for a subsequent period. There exist a number of ways of providing for directed flows. For example one or more moving walkways can be provided. Where a change in level exists between a first and a second location a number of escalators can be used with one or more passing from the first to the second location and one or more passing in the opposite direction. Where the direction of main flow needs to be changed the proportion of walkways or escalators to accommodate the changed flow can be increased.

When the scale of operations is reduced to allowing the passage of people from one location to another by way of a door current systems present flow restrictions. Typically in a stadium to allow people to exit, but not enter (or vice versa) barriers are used in the form of a turnstile, where a rotating element creates a moving space that a human can enter. As the rotating element moves, the human transfers from one side of the turnstile to the other. Barriers serve to limit movement in the other direction. Rotating doors are used in public buildings such as shops and airports. These allow people to move in either direction (into, or out of, the building). They also serve to reduce draughts and so reduce the heating or air conditioning costs. One disadvantage of rotating doors is that the throughput of people, for a given door width, can be quite low since something less than half the door aperture can be used for the progression of users in each direction. Turnstiles are even more limited in throughput of people, as one half of the rotating turnstile is 'dead space'.

European Patent Application 0 921 262 A1 (Nisshin Steel) discloses a closure member comprising a flexible sheet curved wavily so as to wave in the horizontal direction and a drive which causes the flexible sheet to wave forward. A closure structure comprises this closure member and is further provided with a wall member on each side of the flexible sheet in the hill-to-valley direction in its side view, which may further be provided with a moving floor beneath the flexible sheet

SUMMARY OF THE INVENTION

According to a first aspect of the present invention there is provided a method for regulating a flow of individual people or other animals through an aperture on a path from a first to a second location on the path wherein a movable closure member is located in the path and caused to generate along the path an entry region, a traversing region, and an exit region characterised by the steps of:

locating in the aperture a closure member defined by a sequence of discrete vertical elements;

providing for the displacement of at least some of the elements transverse the path so as to cause the barrier to reproduce a wave like motion in a direction along the path so as to cause the barrier to generate along the path:

the entry region which is open towards the first location but isolated from the second location;

the traversing region generated from the entry region by progressive movement of the barrier, and the exit region generated from the traversing region by further progressive movement of the barrier, the exit region being open towards the second location but isolated from the first location; and regulating the displacement of the elements so that adjacent elements in the barrier subject to regulated displacement cause the barrier to conform to one of a number of available pre-determined reproducible wave like pattern.

According to a second aspect of the present invention there is provided a flow control means for location within an aperture to regulate a flow of individual people or other animals through the aperture on a path from a first location on one side of the flow control means to a second location on the other side of the flow control means to the one side characterised by:

a barrier defined by a sequence of vertical elements;

means for driving the sequence of elements so that the barrier serves to generate one of a number of predetermined reproduced wave like forms between the first and second location such that the barrier serves to create in sequence:

an entry region for occupation by at least one individual which entry region is initially open towards the first location but isolated from the second location;

a traversing region on the path generated from the entry region by progressive movement of the barrier, and an exit region open towards the second location but isolated by means of the barrier from the first location.

According to a third aspect of the present invention there is provided a flow control means for location within an aperture to regulate a flow or individual people or other animals on a flow path extending from a first location on one side of the flow control means to a second location on the other side of the flow control means characterised by:

a series of tracks extending transverse the flow path for location at or near an upper or lower boundary defined by the flow control means;

an individual support means extending into each track in the series thereof; each support means being associated with, and serving to support, an element of the barrier;

means for reciprocating an individual support along its track so as to cause support elements in the barrier to conform to one of a number of available predetermined patterns of reproduced wave like pattern such that during displacement the barrier serves to create in sequence:

an entry region for occupation by at least one individual which entry region is initially open towards the first location but isolated from the second location;

a traversing region on the path generated from the entry region by progressive movement of the barrier, and an exit region open towards the second location but isolated by means of the barrier from the first location.

According to a preferred version of the second or third aspects the flow control means is adapted for use as a mobile structure.

According to another aspect of the present invention there is provided a compound flow control means comprising two or more flow control means according to the second or third aspects.

According to yet another preferred version of the fourth aspect of the present invention the two or more flow control means are located side by side each in its own separate aperture and coupled for control as a unit. Typically the paths of each flow means are substantially parallel to one another.

According to a next preferred version of the present invention there is provided a structure equipped with a flow means according to the second, third or fourth aspects or any preferred versions thereof.

According to a sixth preferred version of the second or third aspects of the present invention there is provided a structure equipped with a flow control means according to the second or third aspects or the first preferred version thereof or a compound flow means according to the fourth or fifth aspects.

The term 'barrier' is herein used to describe an active flow controlling device having a more or less continuous mode of operation independently of the number of people or objects being allowed to flow. Other possible descriptive terms for flow control devices located in an aperture are 'curtain' or 'door' but these are inherently passive devices involving dependent on actual use by a user or object.

The present invention shows a novel way of implementing a one way barrier that allows use of the maximum aperture space available, and has a more pleasing, and less intimidating appearance than a turnstile. Two of the proposed barriers, side by side, (in effect on flow being in parallel) would allow shops to present a novel and interesting entrance to shoppers, with the added advantage that the barriers can both be set to "out only" when it is time to vacate the building or an emergency arises requiring the building to be cleared. The proposed barrier will find applications in airports where passenger management is required for exit from and entry to restricted areas, and diode-like devices such as turnstiles are unacceptable.

A flow control means of the present invention can be incorporated into a mobile assembly enabling it to be used temporarily in a building doorway or to enable access to a sports ground or a temporary arena. Such an assembly would require the provision of electricity, such as from a mobile generator either built into the assembly or connected to the assembly by power cables.

The concept of a travelling transverse wave is well known. In the case of a surface wave at a liquid/air interface (for example the surface of the sea), a wave appears to propagate along the surface, whereas the motion of the molecules of water at the surface is predominately transverse to the direction of motion. Another example of a transverse wave is that propagated in a skipping rope when the end is flicked.

In one version of the present invention, a barrier for an aperture comprises a multiplicity of rods hung from one end from a ceiling of the aperture. Each rod is caused to move in concert with the remainder along an individual track in the ceiling each track being at right angle to the direction in which people move through the aperture. The rods are moved relative to one another so that a travelling wave is set up, enabling people to freely move in one direction from one side of the aperture to the other, but not in the reverse direction.

The barrier may be driven in a first direction, be stopped, or be driven in the opposite direction to the first. In this way the barrier is readily controlled to provide for people to pass either in a first direction through the aperture, or to pass in the opposite direction to the first through the aperture, or to prevent the passage of people through the aperture. Additional controls are readily provided to ensure that all the rods may be moved to one side to provide a completely open aperture when required.

The barrier provides for interior ventilation to be maintained by means of its pumping action cause the transfer of air from the upstream side of the aperture to the downstream side. Thus the barrier can serves as a low power, low noise fluid displacement system. In this context it can serve to provide for cutting down air flow through an aperture which could be particularly significant for control of air flow into, or egress of smoke out of, the aperture in the event of a fire within a building to which the aperture provides access.

The barrier is particularly discussed hereafter in terms of a system for controlling the flow of people through an aperture in an atmosphere of air. However it would be applicable for other fluids and for mobile objects other than people. Typically it could be used to control movement on fish in a storage tank.

The motion of the barrier can be in the form of sinusoidal wave, although other wave shapes may be used. A triangular waveform is advantageous in one particular respect as when generated by means of a barrier comprising a sequence of rods each bearing a non-elastic panel which are hinged to one another. Such a barrier can be used to seal the aperture in which it is located, as the distance between the rods remains constant with a triangular wave. This is not the case with the sinusoidal wave.

The wave form can be selected depending on the objects to be allowed to flow through. Thus where the object is of a width approaching that of the width of the aperture, say for a motor vehicle when the aperture provides access to a car park, then the selected wave form can be of squarer or rectangular shape. It is also envisaged that the control system for the flow control means can vary the wave form in dependence on the size or shape of the object to be allowed to pass through the aperture.

BRIEF DESCRIPTION OF THE DRAWINGS

Two exemplary embodiments of the invention will now be described with reference to the accompanying drawings of a flow control barrier of which.

DETAILED DESCRIPTION OF THE INVENTION

Figure 1:
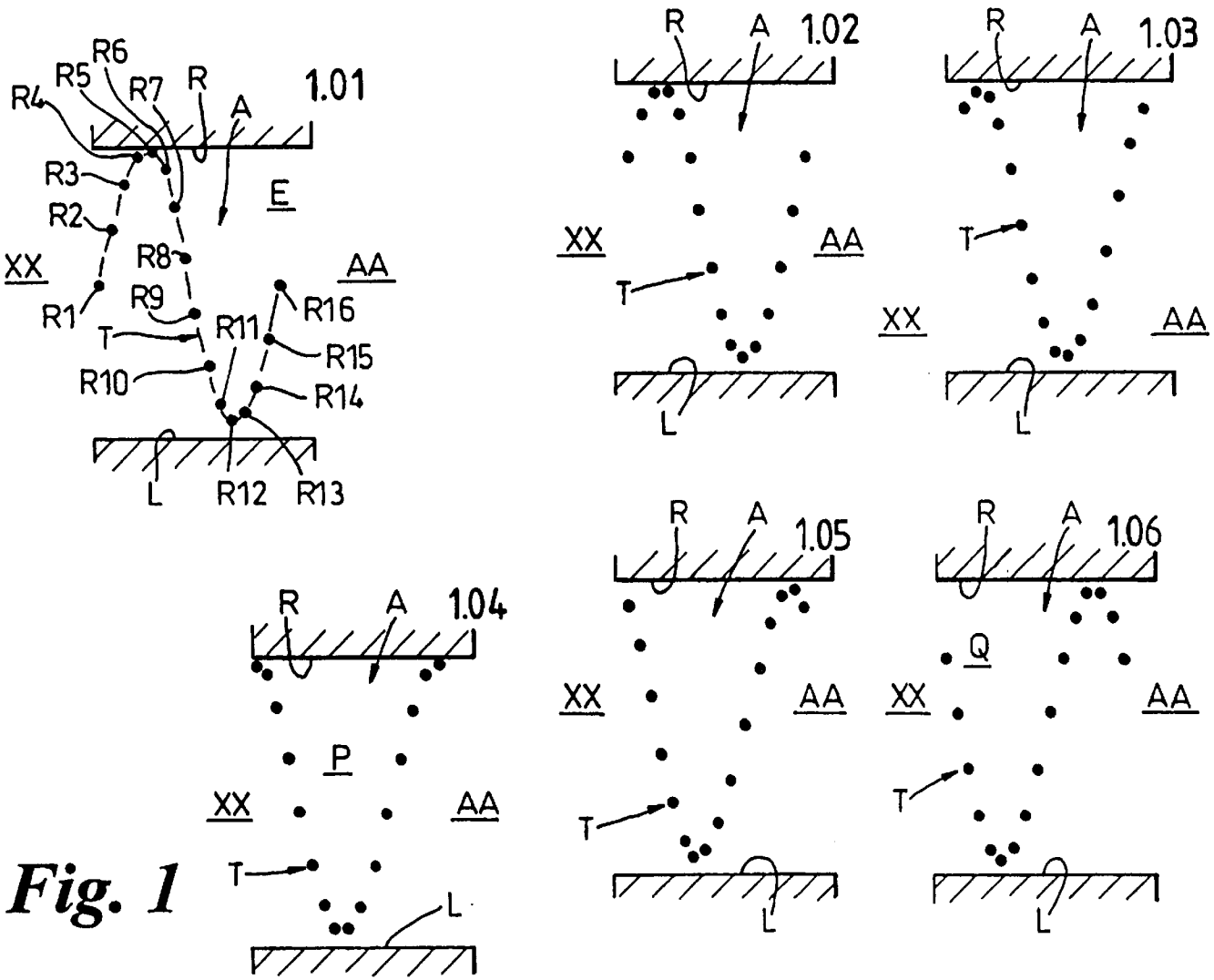
FIG. 1 comprises diagrams 1.01 to 1.12 each showing show a top view of a first embodiment comprising a barrier of rods with each diagram showing the barrier with its components in different relative positions during the course of a working cycle.
Figure 1:
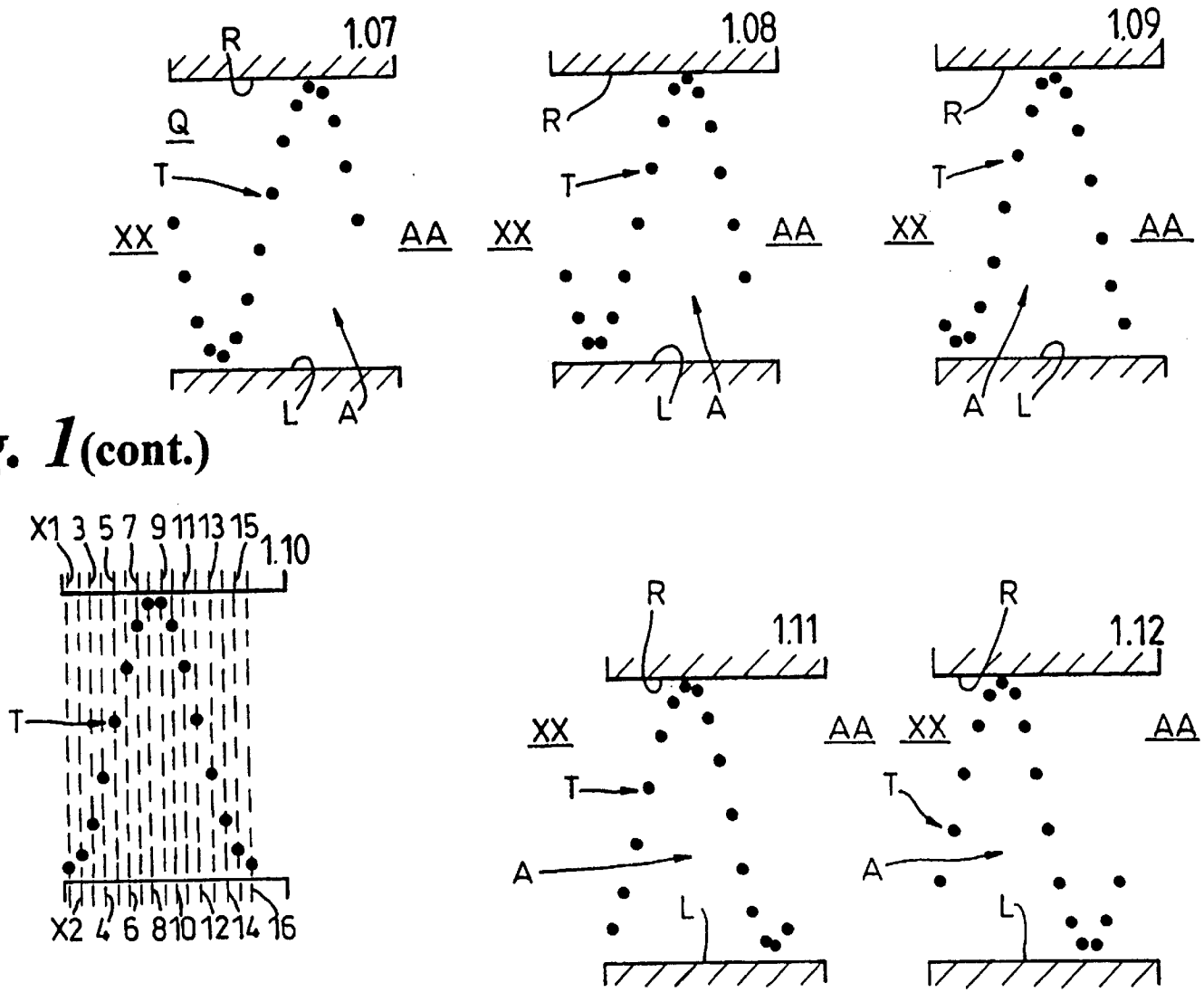

First Embodiment, FIG. 1, Diagrams 1.01 to 1.12

An aperture A with side walls L, R serves to join an upstream floor area AA from a downstream floor area XX. The aperture A incorporates a barrier T embodied by sixteen rods R1–R16. Each rod R1 to R16 is mounted by way of its upper end on, respectively, individual track X1 to X16 (see Diagram 1.10) mounted in ceiling of aperture A. The tracks X1 to X16 span aperture A from side to side. Each rod R1–R16 is driven on its own track by a linear motor. The motors, and so the rods R1 to R16, are driven in concert by a computer controlling the operation of the linear motors to cause the barrier T to conform in plan to a moving wave pattern. As shown in the Diagrams 1.01 to 1.12 the pattern is substantially a sine wave but other wave forms can be applied as long as they create a travelling plan profile needed to establish the required pattern of movement through aperture A. The aperture A provides for:

entry region E (shown initially in 1.01) from upstream of the aperture A and open to the incoming side AA but isolated by the curtain T from the outgoing side XX; traversing region P (1.04) isolated by the barrier T from sides AA, XX; and outgoing region Q (1.06) open to outgoing side XX but closed from incoming side AA.

In use the rods each follow a linear path which results in the three regions (regions E, P Q) which are bounded to a greater or lesser extent as the barrier T varies in shape during the working cycle.

Each rod R1 to R16 is mounted by way of a load sensor, so that if a person in the door falls over or pushes against the rods, this will be detected, and the curtain T will stop.

People enter from the right (FIG. 1) from side AA are constrained to pass through to the side XX in conformity with the transitory regions formed during a working cycle of the barrier T. Diagrams 1.01 to 1.12 are sequential representations of the barrier T, showing the transverse wave movement generated by the motion of the rods R1 to R16 which though individually travelling on a straight path collectively as barrier T serve to define a sequence of regions E, P, Q of varying shape imparting the desired direction of travel to people passing through the aperture.

The required position of each rod R1 to R16 in the barrier T is calculated in real time by a computer. The computer then sends the appropriate real time positional command to each of the 16 linear motors which then serve to position the rods R1 to R16 in the barrier T correctly relative to other rods and to the aperture A. The computer can also provide for monitoring functions such as:

a load sensor in the rods to detect when someone or a an object passing through the aperture A stops moving resulting in a contact with, and so loading of one or more parts of the barrier T;

temperature and/or smoke sensors serving to detect the occurrence of air borne temperature and/or smoke variations generated either within a region of the barrier or elsewhere but caused to passed through the aperture;

INDUSTRIAL APPLICABILITY

The barrier area can be readily illuminated and signed to provide for user friendly access. It can be readily scanned by video system.

The barrier can be formed of a range of materials and vary between being substantially transparent or opaque.

The barrier can incorporate instructional, advertising or other display material such as a map of the locations lying on the downstream side of the barrier.

A simple keypad enables the operator of the barrier to select the direction of movement through the aperture or to close the aperture. If necessary the barrier can be driven to a fully open configuration when the computer will cause all the rods to one side of the aperture.

Typically the computer uses the following calculation to calculate the position of each rod:

$$\text{Position of rod } N \text{ at time } T \text{ seconds} = W/2 \times \sin(24N + T/P \times 360)$$

(Where:

N is rod number 0 through 15,

T is the time in seconds,

W is the width of the door,

P is the period (the time for one cycle of the barrier) in seconds.

The position calculated is measured from the centre of the barrier.

Second Embodiment, FIGS. 2 to 6

FIGS. 2 to 6 variously show a barrier 1 (or components incorporated in it) in the form of a flexible curtain to provide a for a triangular wave pattern for directing flow through an aperture A with side walls 3L and 3R.

Figure 2:
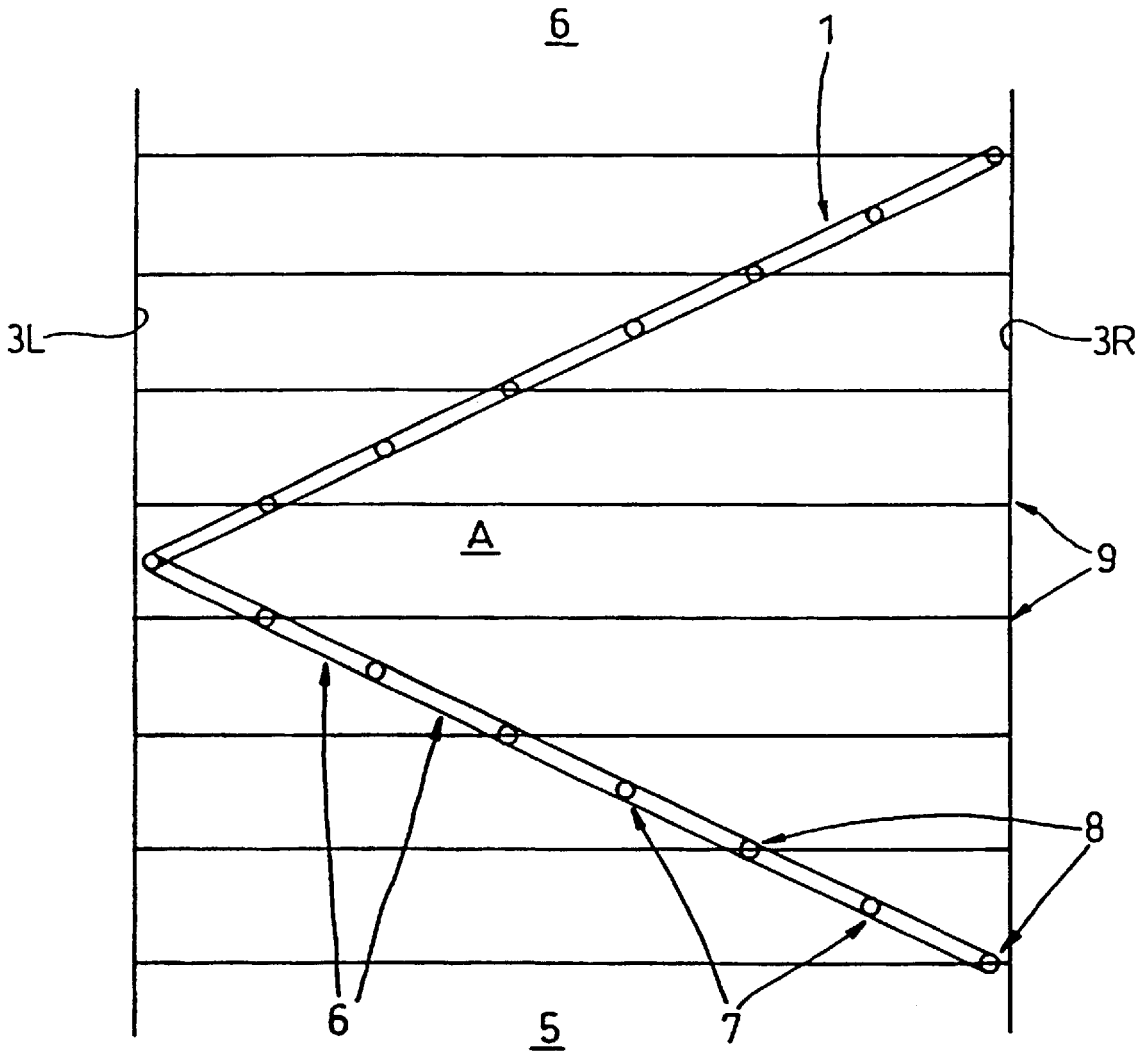
FIG. 2 is a top view of a second embodiment showing a barrier of hinged segments.
Figure 3:
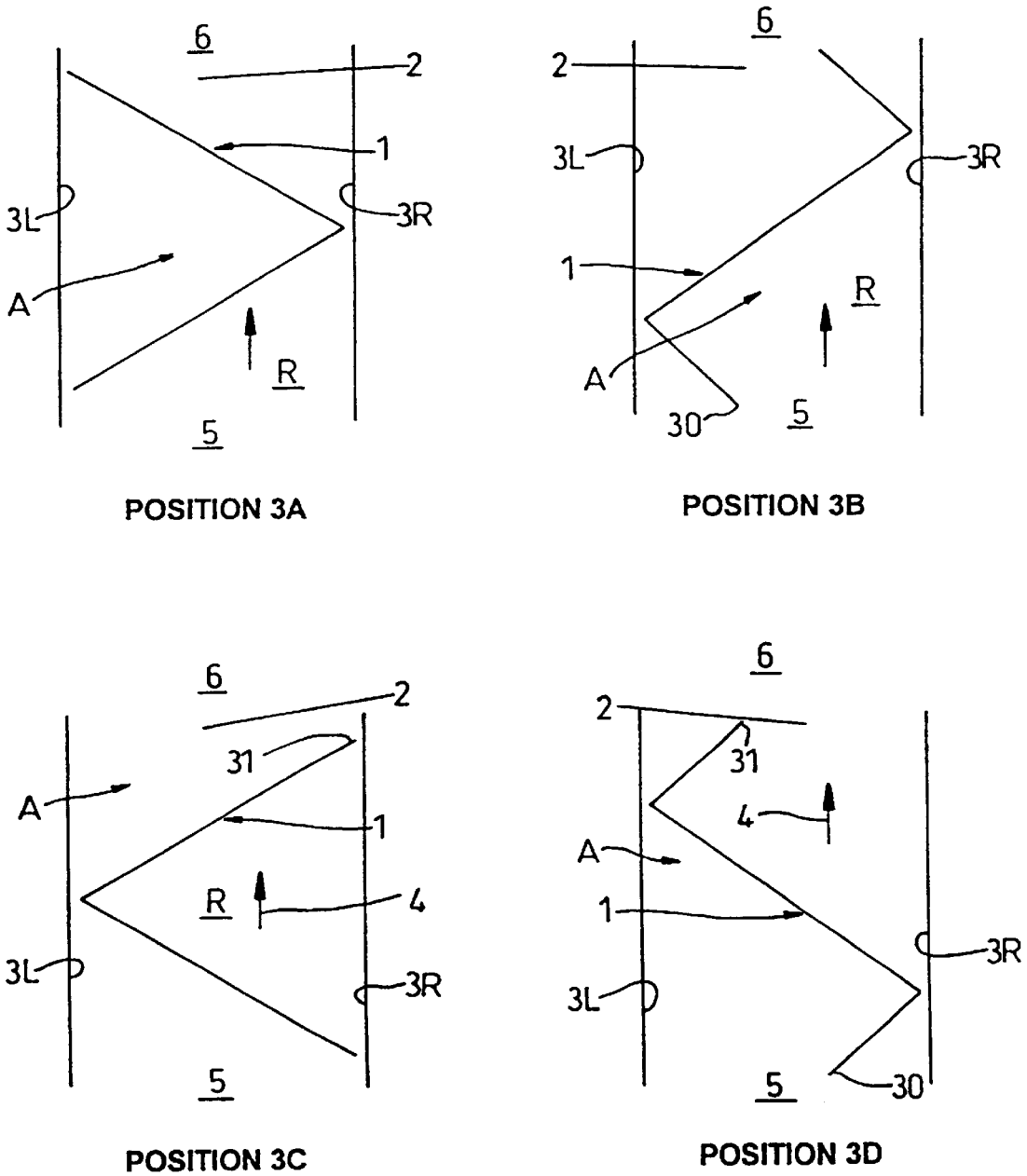
FIG. 3 shows diagrammatically a sequence of top views of the barrier of FIG. 2 with its components in different relative positions during the course of a working cycle.

FIGS. 2 and 3 shows the barrier 1 suspended between wall 3L, 3R to regulate flow from inlet side 5 to outlet side 6 (these flow directions can be reversed if required). The barrier 1 is caused to move in a triangular wave like motion to provide a moving space for people to traverse the aperture in the required direction.

FIG. 3 shows by diagrams 3A to 3D cycle of operation of the barrier 1.

Diagram 3A shows the starting position with people moving towards inlet side 5 and starting to enter mobile traversing region R generated by moving upstream end 30 of barrier 1.

Diagram 3B shows the position where people having entered the traversing region R while the upstream end 30 is travelling towards side wall 3R to eventually temporarily isolate region R as shown in Diagram 3C. Here region R is isolated from inlet side 5 and downstream end 31 of barrier 1 starts to travel from wall 3R to provide access for people from the mobile region R to outlet side 6.

Diagram 3D shows the configuration of barrier 1 as both upstream end 30 and downstream end 31 travel towards wall 3L so restoring the barrier 1 to the position shown in Diagram 3.1 where the working cycle starts again.

Figure 4:
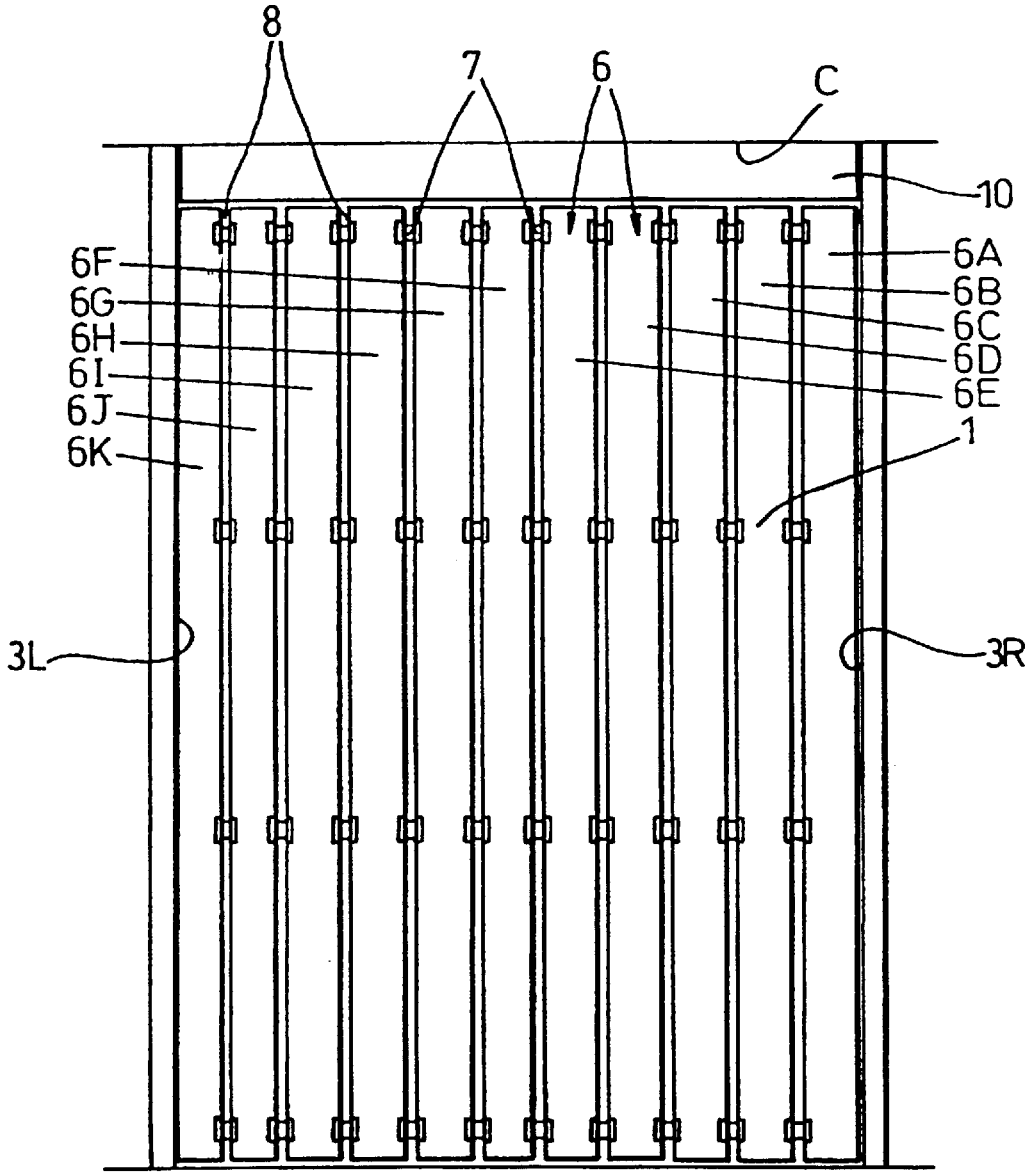
FIG. 4 is a front view of the barrier of FIGS. 2 and 3.
Figure 5:
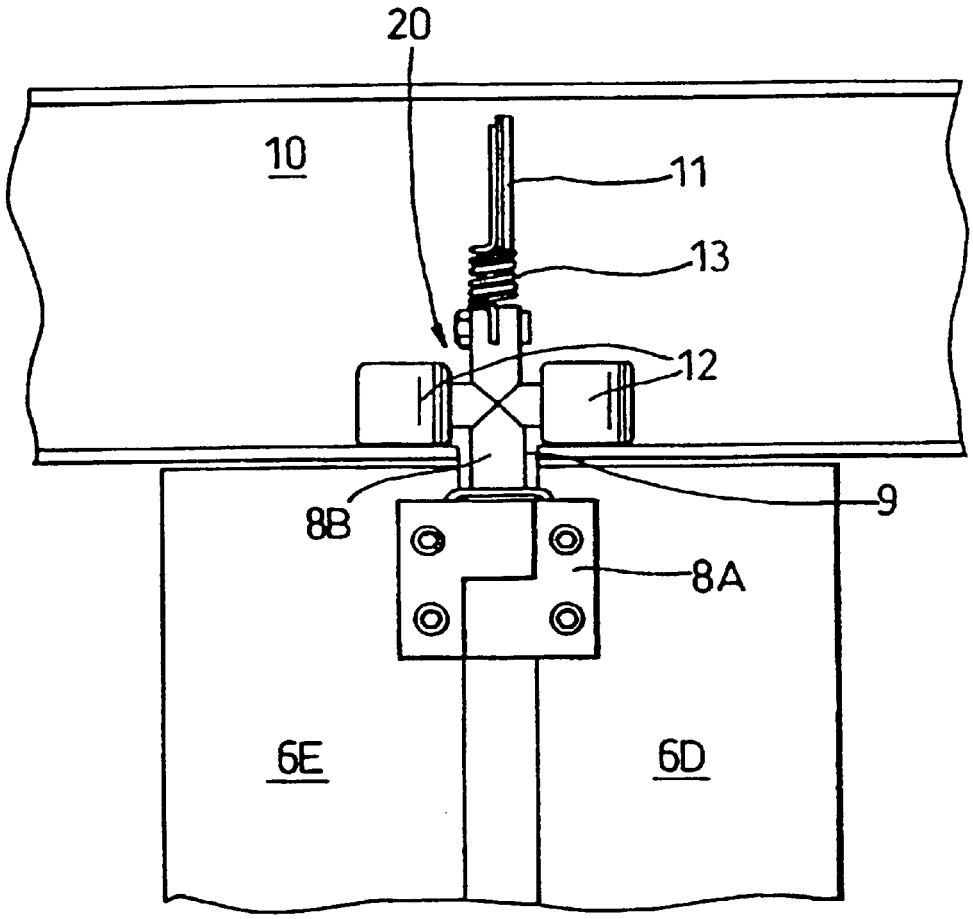
FIG. 5 is a detail of a component of FIG. 4.
Figure 6:
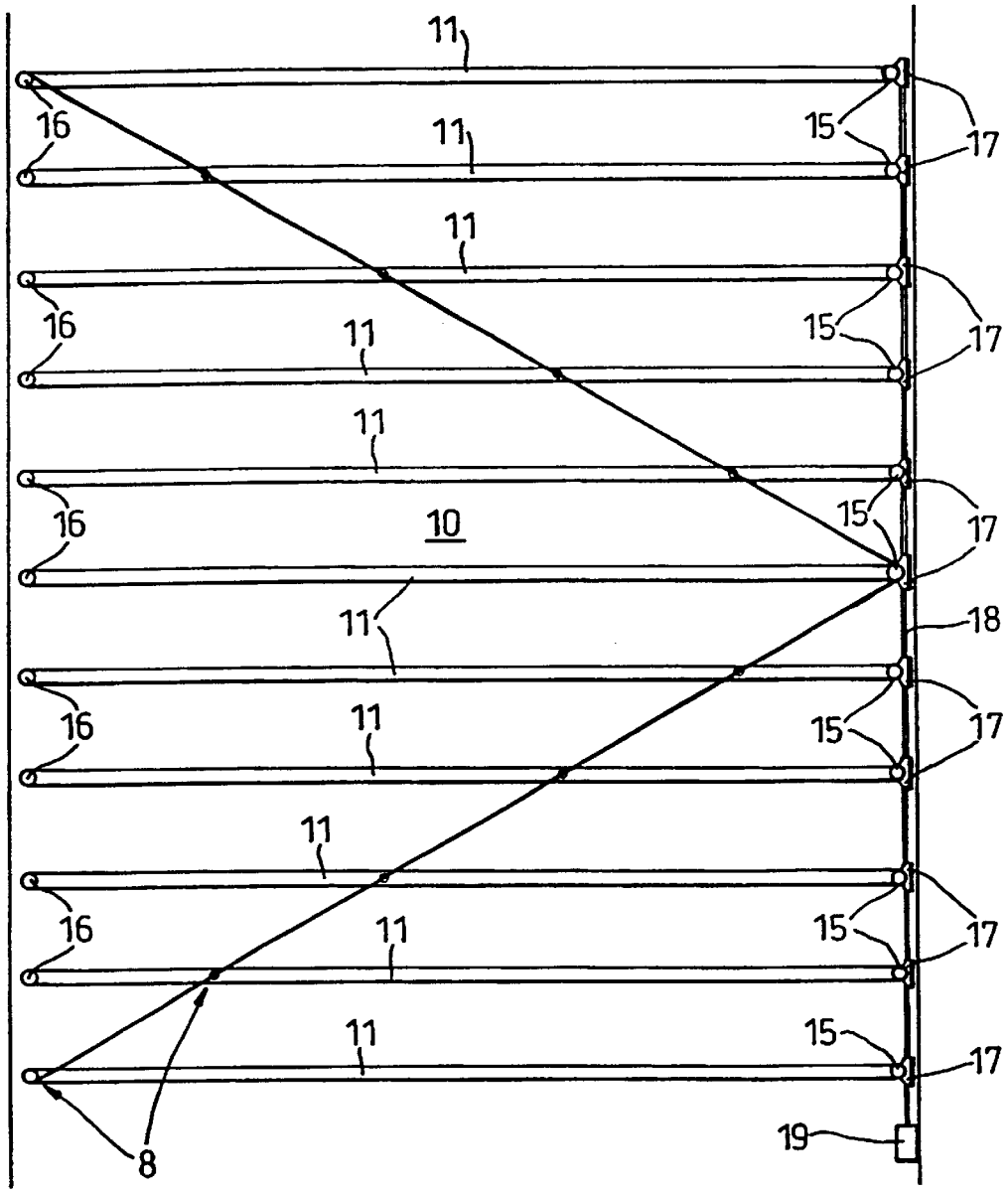
FIG. 6 is a plan view of components referred to in connection with FIGS. 2–5.

FIGS. 4–6 show some constructional details of the barrier 1 and its operating mechanisms.

FIG. 4 shows barrier 1 as a flexible curtain suspended from drive enclosure 10 mounted on ceiling C of aperture A. The curtain is made up of vertical glass segments typically 6A to 6K connected by way of curtain hinge 7 every alternate hinge further including a hanger supporting the upper end of two curtain segments.

FIG. 5 shows a hinge and hanger 8 in more detail. Two curtain segments 6D, 6E are connected by way of hinge 8A and suspended by way of hanger 8B. The hanger 8B extends through slot 9 into the interior of drive enclosure 10. Rollers 12 on hanger 8 support the weight of the two segments 6D, 6E. Upper part 20 of the hanger 8 is coupled to a timing belt 11 by means of which the hanger 8, and so the suspended segments 6D, 6E can be driven back and forth along slot 9. Spring 13 incorporated in upper part 20 provides for compliance in the driving arrangement.

FIG. 6 shows in plan view from above the interior of the drive enclosure 10 where driving belts 11 are driven in concert so as to create the required triangular wave motion of the barrier 1 (in this case as shown in Diagram 3A). Each driving belt 11 has an associated driven pulley and bevel gear 15. The other extreme of the drive belt runs around a free wheeling pulley 16. Each driven pulley and bevel gear 15 is driven by a worm drive 17. All the worm drives are connected together by shaft 18 which is driven by way of a motor and gearbox assembly 19.

In FIG. 5 the slots 9 and upper units 20 and in FIG. 6 the drive belts 11 in conjunction function to displace the barrier 1 on a series of parallel paths lying at right angles to the path from the first to the second location. In an alternative embodiment corresponding slots can be provided at some other angle than a right angle to the path through the aperture so that the barrier can be formed into wave shapes of different overall configuration in comparison to the one described in relation to FIGS. 2 to 7, The invention is particularly concerned with, but is not limited to, a method and apparatus for controlling the flow of people through an aperture. It will be apparent that the concept can be applied to controlling the movement of other animals and also in relation to fluids other than air. Thus a barrier according to the invention could be used in fish tanks for regulating movement of fish

What is claimed is:

1. A method for regulating flow through an aperture on a path from a first to a second location on the path, the method comprising the steps of:

locating in the aperture a movable barrier defined by a sequence of discrete vertical elements;

providing for transverse displacement of the vertical elements, each of the vertical elements being supported by a support and each support being driven along one of a plurality of parallel tracks by a drive, the drive having a plurality of belts with each belt driving one of the vertical elements so as to cause the barrier to reproduce a wave motion in a direction along the path so as to cause the barrier to periodically generate along the path, an entry region which is open towards the first location but isolated from the second location, a traversing region generated from the entry region by progressive movement of the barrier, and an exit region generated from the traversing region by further progressive movement of the barrier, the exit region being open towards the second location but isolated from the first location; and regulating the displacement of the vertical elements so that adjacent vertical elements in the barrier subject to regulated displacement cause the barrier to conform to one of a plurality of available predetermined reproducible wave patterns.

2. A flow control means located within an aperture to regulate a flow through the aperture on a path from a first location on one side of the flow control means to a second location on another side of the flow control means, the flow control means comprising;

a sequence of a plurality of movable vertical elements, each vertical element being supported by one of a plurality of supports, the vertical elements defining a barrier;

a drive comprising a plurality of belts, each of the plurality of belts engaging and driving one of the plurality of supports along one of a plurality of parallel tracks, so that the barrier serves to generate one of a plurality of predetermined reproduced wave forms between the first and second location such that the barrier serves to create in sequence:

an entry region for occupation by at least one individual which entry region is initially open towards the first location but isolated from the second location, a traversing region on the path generated from the entry region by progressive movement of the barrier, and an exit region open towards the second location but isolated by the barrier from the first location.

3. The flow control means according to claim 2, further comprising a support for use as a mobile structure for insertion into, and subsequent removal from, the aperture through which regulation of flow is required.

4. The flow control means according to claim 2, further comprising two or more flow control means located side by side, in a single aperture and coupled for control as a unit.

5. The flow means according to claim 2, further comprising two or more flow control means located side by side each in its own separate aperture and coupled for control as a unit.

6. The flow control means according to claim 5, wherein the path of each two or more flow control means is disposed parallel to one another.

7. The flow control means according to claim 2 further comprising a support structure.

8. The flow means according to claim 5 further comprising a support structure which includes a plurality of individual parallel tracks extending transversely to the flow path and supporting the barrier.

9. A flow control device comprising a barrier for location within an aperture to regulate a flow of one of an individual and an animal along a flow path extending from a first location, on one side of the barrier, to a second location on another side of the barrier, the flow control device comprising:

a plurality of movable vertical elements defining a barrier;

a plurality of individual parallel tracks, each of the plurality of individual parallel tracks extends transverse to the flow path and has a support which supports one of the vertical elements, and each support is movable along one of the parallel tracks; and a drive, including a plurality of belts, each of the plurality of belts engages and drives one of the vertical elements along one of the parallel tracks so that the barrier serves to generate a desired wave form between the first and second location such that the barrier serves to create periodically a passage through the aperture and regulate the flow of one of individuals and animals therealong.

10. The flow control device according to claim 9 wherein the plurality of individual parallel tracks are supported vertically above the aperture.

11. The flow control device according to claim 9 wherein each support has at least one roller to facilitate rolling and guiding motion of the support along its track.

12. The flow control device according to claim 9 wherein a hinge connects each adjacent pair of movable vertical elements to one another to form the barrier.

* * * * *